United States Patent [19]

Geiger

[11] 4,288,119

[45] Sep. 8, 1981

[54] DOOR LOCKING CABLE

[75] Inventor: Robert G. Geiger, Elkhart, Ind.

[73] Assignee: Air-Flo Co., Inc., Elkhart, Ind.

[21] Appl. No.: 54,665

[22] Filed: Jul. 5, 1979

[51] Int. Cl.[3] ..... E05C 17/04

[52] U.S. Cl. ..... 292/262

[58] Field of Search ..... 292/262, 264, 299, 288; 70/93, 14, 30, 49, 53–55, 417

[56] References Cited

U.S. PATENT DOCUMENTS

| | | | |
|---|---|---|---|
| 1,566,965 | 12/1925 | Johnson | 70/49 X |
| 3,590,608 | 7/1971 | Smyth et al. | 70/49 X |
| 3,798,934 | 3/1974 | Wright et al. | 70/49 X |
| 3,804,454 | 4/1974 | Simmons | 292/262 |
| 4,155,577 | 5/1979 | Raymond | 292/264 |

FOREIGN PATENT DOCUMENTS

| | | | |
|---|---|---|---|
| 398687 | 7/1924 | Fed. Rep. of Germany | 70/49 |
| 173020 | 12/1921 | United Kingdom | 70/49 |

*Primary Examiner*—William E. Lyddane

*Attorney, Agent, or Firm*—Oltsch, Knoblock & Hall

[57] ABSTRACT

A cable lock for doors in which a loop at one end of a cable is attached by a bolt or screw to a building wall adjacent to a door and a larger loop at the opposite end of the cable is applied over and around a doorknob to limit the extent to which the door may be opened. In one embodiment of the lock, a metal sleeve encircles the major portion of the cable between the end loops. The metal sleeve increases the resistance of the device to cutting by bolt cutters, saws, and other burglary tools. A sleeve of resilient material encircles at least part of the cable between the end loops and serves to protect the door and door frame from damage upon contact of the cable therewith.

6 Claims, 7 Drawing Figures

Fig. 1
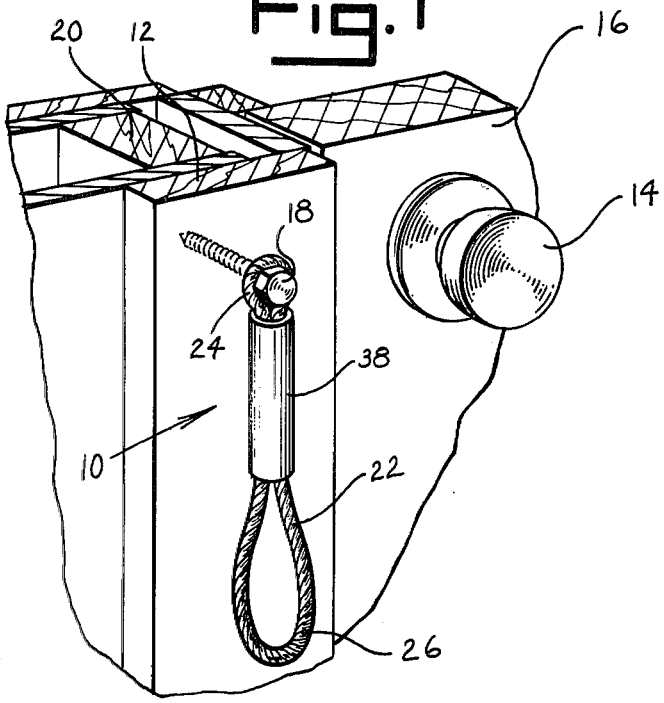
Fig. 2
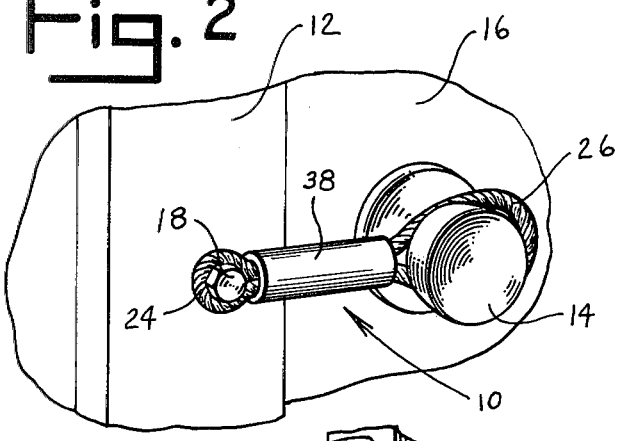
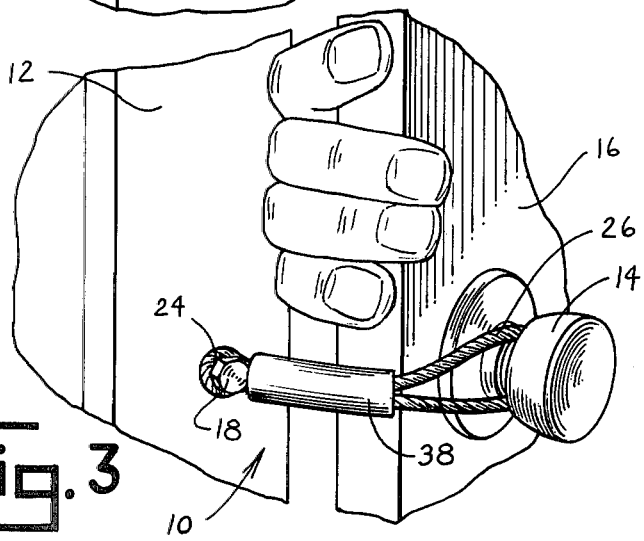
Fig. 3
Fig. 4
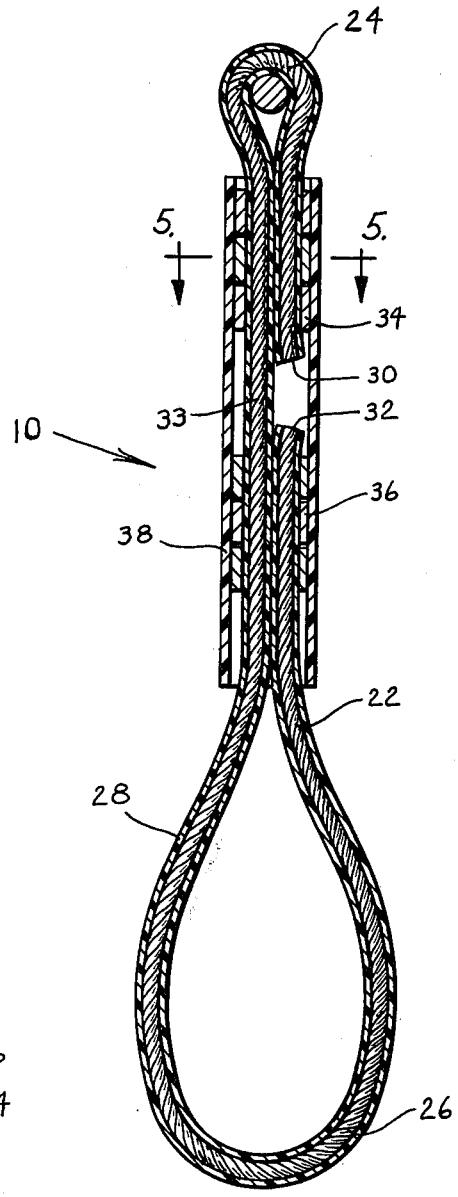
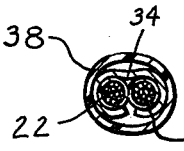
Fig. 5

DOOR LOCKING CABLE

SUMMARY OF THE INVENTION

This invention relates to door locks of the class characterized as night locks or chain locks and which generally include a flexible member attached at one end to a door frame or building wall and carrying a slide member at its free end which may be removably attached to a track member secured to the door when the occupants of a building desire to secure the door against unauthorized entry therepast. Such devices permit slight opening of a door to provide a view of callers, but secure the door against unauthorized entry while the flexible member remains anchored to the door and the building wall. Another prior lock of this class includes a flexible member which is secured to a building wall or door frame at one end thereof and carries a ring member at its opposite end which is of a size large enough to pass over and around a doorknob. When the ring member is applied over the doorknob, the length of the flexible member limits the extent to which the door may be opened.

Prior devices have been subject to one or more shortcomings. Some prior locks permit a door to be forced open, as by an intruder lunging against the door when partly opened. Other prior devices have been so constructed that the use of the device results in marring of the door or door frame. Other locks have been aesthetically displeasing in appearance or are difficult to apply to and release from door locking position. Many prior devices have been expensive to manufacture or have entailed installation difficulties because they are composed of many parts.

In the cable lock of this invention a length of multi-strand steel cable has loops formed at both of its ends. One of the loops is of a size sufficient to slip over and around a doorknob while the other loop is of a size to receive the shank of a bolt or a screw attached to a door frame and be retained by the head of said bolt. The length of the cable between the loops is chosen to insure that when the small loop is attached to a door frame and the larger loop is slipped around a doorknob, the door cannot be opened more than a few inches. The size of the small loop and the location of the retaining bolt or screw on the door frame are chosen to accommodate a large bolt or screw which is strong and of a length to extend deeply into the building wall, as into a wall frame or into a stud to insure that the cable is anchored solidly against an intruder's effort to dislodge it. One embodiment of the lock has metal compression sleeves applied to the cable along substantially its entire length between the loops to firmly anchor together return bent portions of the cable. These sleeves additionally increase the lock's resistance to bolt cutters, saws, and other cutting tools. The cable and compression sleeves may be sheathed with a resilient material, such as a polyvinyl-chloride, to prevent the cable from marring the door and door frame. A sleeve of resilient material is carried on the lock between the end loops and likewise prevents the metal sleeves from marring the door or door frame. This sleeve may be rotatable about the device and thus make the lock more resistant to cutting with a saw.

It is an object of this invention to provide a door cable lock which is strong and which effectively resists unauthorized release thereof and forces applied to open the door.

Another object is to provide a cable lock which will minimize the possibility of marring the door or door frame at which it is installed.

Another object is to provide a cable lock which is aesthetically attractive.

Another object is to provide a lock which is of strong and simple construction and is easily manufactured.

Other objects will be apparent from a reading of the following specification.

BRIEF DESCRIPTION OF THE DRAWINGS

FIG. 1 is a fragmentary perspective view of a lock attached to a door frame and in its released or inoperative position.

FIG. 2 is a fragmentary perspective view of the cable lock in operative position locking a door.

FIG. 3 is a fragmentary perspective view illustrating the limited extent to which a door may be opened when the cable lock is operatively positioned.

FIG. 4 is a longitudinal, sectional view through the cable lock.

FIG. 5 is a transverse sectional view taken along line 5—5 of FIG. 4.

DESCRIPTION OF THE PREFERRED EMBODIMENTS

Figure 6:
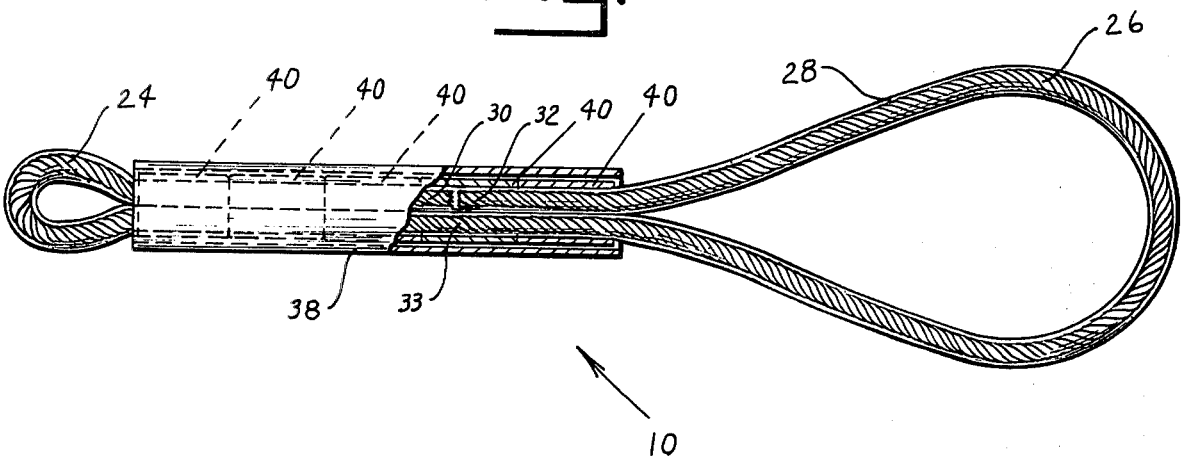
FIG. 6 is a view of another embodiment of the cable lock with parts broken away for purpose of illustration.

The preferred embodiments illustrated are not intended to be exhaustive nor to limit the invention to the precise forms disclosed. They are chosen and described to illustrate the principles, application, and practical use of the invention and to thereby enable others to utilize the invention.

Referring to the drawings, the number 10 designates the cable lock, one end of which is secured to a door frame 12 near the doorknob 14 of a door 16 by a bolt or lag screw 18. Lag screw 18 preferably is elongated to extend through the door frame 12 and be anchored in the interior wall frame structure, such as a wooden stud 20. Cable lock 10 includes a length of multi-strand steel cable 22 which is return bent to form loops 24 and 26 at its ends. Cable 22 may be sheathed within a resilient material 28, such as polyvinyl chloride.

As shown in FIG. 4, loops 24 and 26 are formed by bending cable 22 back on itself and clamping the return bent ends 30 and 32 to the adjacent or intermediate portion 33 of the cable by means of metal sleeves 34 and 36 which firmly grip the contacting parts of the cable. The clamps or sleeves 34 and 36 are forceably crimped or collapsed upon the cable part 33 and cable ends 30 and 32 to securely attach the cable ends 30 and 32 to adjacent cable part 33. The cable lock is of a length and loop 26 is of a size large enough to permit the loop 26 to slip or pass around a doorknob 14 to the position shown in FIG. 2 when the cable is anchored to the building wall. Loop 24 is smaller and is of a size to receive the shank of a bolt or lag screw 18 and smaller than the head of said bolt or screw.

A sleeve or tube 38 of resilient material is preferably carried by and encircles the major portion of the cable 22 and sleeves 34 and 36 between the loops 24 and 26, and preferably is rotatable thereon.

FIG. 6 shows another embodiment of cable lock 10 in which a number of clamp sleeves 40, similar to clamp sleeves 34 and 36, have been applied to cable part 33 and cable ends 30 and 32 to extend substantially the length of the cable lock between loops 24 and 26. Sleeves 40 increase the resistance of cable lock 10 to severing thereof by bolt cutters, saws, and other cutting tools.

Figure 7:
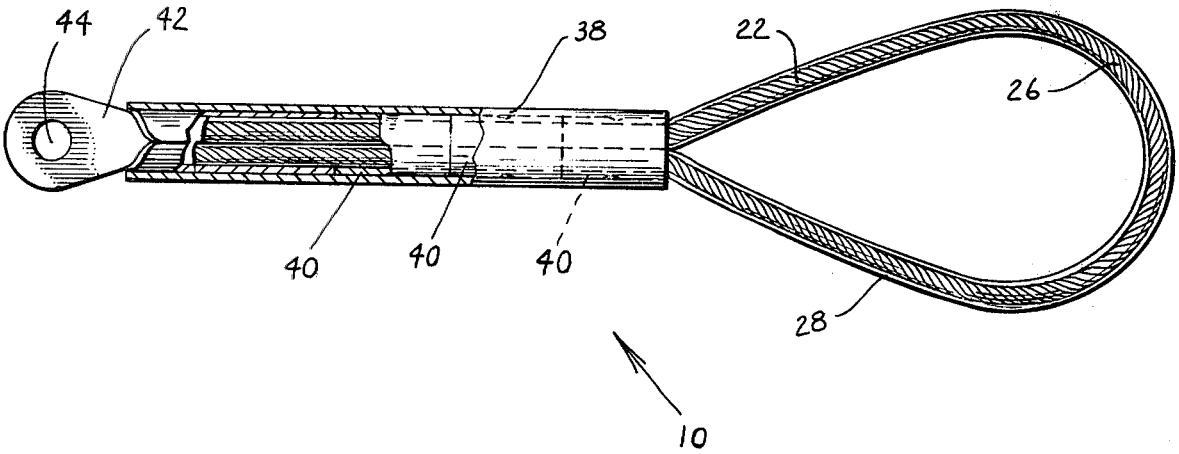
FIG. 7 is a view of still another embodiment of the cable lock with parts broken away for purpose of illustration.

Another embodiment of the cable lock is shown in FIG. 7. In this embodiment, an elongated member 42 having a hole 44 in one end is attached to one end of cable 22 opposite from loop 26. Member 42 has a tubular shank which receives and is forceably collapsed or crimped upon a substantial part of cable 22 in a manner similar to the anchorage of sleeves 34, 36 and 40. It will be understood that member 42 will be attached to door frame 12 as by screw 18 and that this embodiment will not include a small loop 24. The opposite end of the cable lock is similar to loop 26.

This cable lock is installed by securing one end to a door frame 12, as by a lag screw or bolt 18 which preferably extends into the building wall and into a frame or stud 20 therein. The lock is positioned proximate to doorknob 14 so that loop 26 may be slipped around the knob, as shown in FIG. 2. FIG. 3 illustrates the limited door opening which is allowed by the cable lock 10 when installed and operatively positioned. The loop 26 encircles the shank of knob 14 and prevents opening of the door beyond a short distance, preferably not more than an inch or two. The opening of the door is preferably restricted to an extent to prevent the entry of an intruder's hand beyond the fingers, as viewed in FIG. 3. Thus, an intruder cannot reach beyond the door to grab an occupant, to release loop 26 from the doorknob, or to pass a knife or gun through the door opening. The opening permitted is sufficient to enable building occupants to view and to speak to callers without exposing themselves to attack or injury by a potential intruder.

It is to be understood that this invention is not to be limited to the precise forms described but that it may be modified within the scope of the appended claims.

What I claim is:

1. A cable door lock comprising a flexible metal cable bent to define a loop at one end and including securing means for attaching the cable to a door frame at the opposite end, said loop being of a size to slip around a doorknob, metal means clamping said loop defining cable portion to an intermediate portion of said cable, and a sleeve encircling and rotatable on the major portion of said cable and clamping means between said loop and said securing means.

2. The cable lock defined in claim 1, wherein said securing means is a loop of cable of a size to receive the shank of a headed screw and smaller than the head of said screw.

3. The cable lock defined in claim 2, wherein adjacent parts of each of said loop-forming cable parts are anchored to the central portion of said cable by a plurality of metal clamping sleeves crimped around said anchored cable parts.

4. The cable lock defined in claim 3, wherein said metal clamping sleeves extend for substantially the entire length of said cable between said loop and said securing means.

5. The cable lock defined in claim 1, wherein said securing means constitutes an elongated metal member having an opening in one end and a tubular shank encircling and crimped on said cable to define said clamping means.

6. The cable lock defined in claim 1, wherein said sleeve is resilient.

* * * * *